US006761666B2

(12) United States Patent
Chou

(10) Patent No.: US 6,761,666 B2
(45) Date of Patent: Jul. 13, 2004

(54) RECIPROCAL DEVICE HAVING SENSING FEATURE

(75) Inventor: Aileen Chou, Chai Yi (TW)

(73) Assignee: Energy Star Co., Ltd., Taichung (TW)

( * ) Notice: Subject to any disclaimer, the term of this patent is extended or adjusted under 35 U.S.C. 154(b) by 123 days.

(21) Appl. No.: 10/235,745

(22) Filed: Sep. 6, 2002

(65) Prior Publication Data

US 2004/0048721 A1 Mar. 11, 2004

(51) Int. Cl.[7] ..... A63B 21/02; A63B 23/04
(52) U.S. Cl. ..... 482/52; 482/80
(58) Field of Search ..... 482/51–53, 79–80, 482/128, 74, 121–125

(56) References Cited

U.S. PATENT DOCUMENTS 3,295,847 A * 1/1967 Matt, Sr. ..... 482/80
3,741,540 A * 6/1973 Shimizu ..... 482/80
4,111,416 A * 9/1978 Jinotti ..... 482/80
4,279,415 A * 7/1981 Katz ..... 482/80
4,842,273 A * 6/1989 Schmeiss ..... 482/49
4,900,012 A * 2/1990 Fu ..... 482/52
5,040,786 A * 8/1991 Jou ..... 482/128
5,147,256 A * 9/1992 Silagy ..... 482/47
5,830,111 A * 11/1998 Johnston ..... 482/52

* cited by examiner

*Primary Examiner*—Steve R Crow
(74) *Attorney, Agent, or Firm*—Rosenberg, Klein & Lee

(57) ABSTRACT

A reciprocal device for exercise machines includes a base having a plurality of positioning rods and stop members on a top surface thereof and each positioning rod has a spring mounted thereto. A movable member has a plurality of sockets which are mounted to the springs and the positioning rods. A cover is mounted to the movable member. The base and the movable member each have a sensing rod and the two sensing rods are located in alignment with each other so that when the movable member is stepped downward, the two sensing rods contact and send a signal to allow the exercise machine to process a function.

4 Claims, 8 Drawing Sheets

RECIPROCAL DEVICE HAVING SENSING FEATURE

FIELD OF THE INVENTION

The present invention relates to a reciprocal device that has two sensing rods on two parts which are moved relative to each other, the two sensing rods contact with each other when one part is moved toward the other.

BACKGROUND OF THE INVENTION

A conventional stepping exercise machine or climbing exerciser has two pedals that are pivotably connected to the base of the exercise machine and moved up and down by the user. The pedals can be bounced back and the user steps them down to exercise the muscle of legs. The resistance of the pedals is provided by hydraulic cylinders. An inherent shortcoming of the conventional exercise machine is that the hydraulic cylinders are heavy and expensive. The hydraulic cylinders need to be maintained frequently to ensure no leakage is found. Besides, a space between the pedals and the top surface of the base could be a dangerous space because children could insert their hands or legs in the space and are injured by the down movement of the pedals.

The present invention intends to provide a reciprocal device for an exercise machine and springs are connected between the two parts of the device. Two sensing rods are connected to the two parts and contact with each other to send a signal to perform a pre-set function.

SUMMARY OF THE INVENTION

In accordance with one aspect of the present invention, there is provided a reciprocal device for exercise machines and the device comprises a base having a plurality of positioning rods and stop members on a top surface thereof and each positioning rod has a spring mounted thereto. The base has a first sensing rod extending from the top surface thereof. A movable member has a plurality of sockets which are mounted to the springs and the positioning rods. A second sensing rod extends from the underside of the movable member. The first sensing rod and the second sensing rod are located in alignment with each other. A cover is mounted to the movable member.

The primary object of the present invention is to provide a reciprocal device that uses springs or resilient members to let the movable members be operated reciprocatingly.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
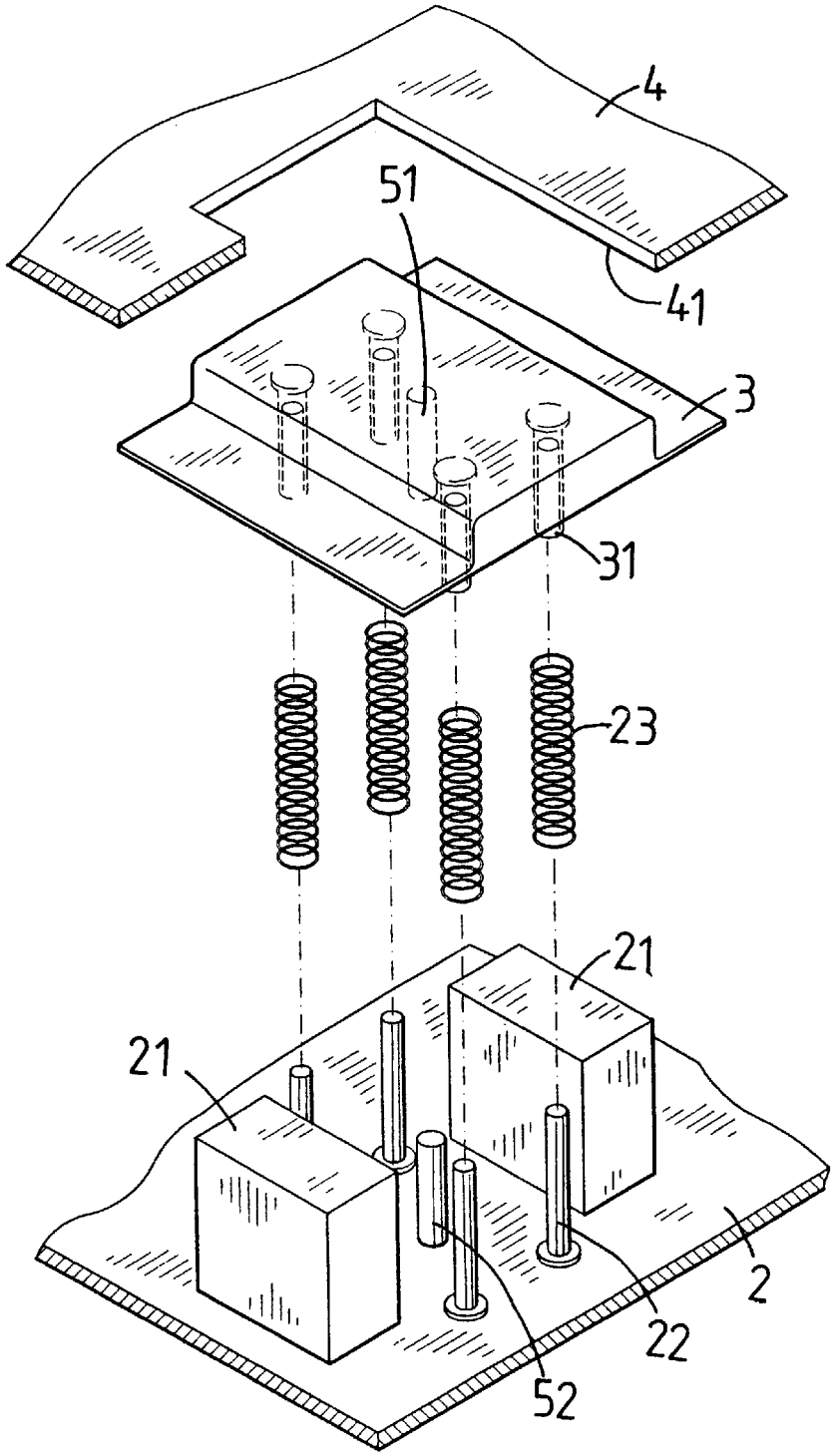
FIG. 1 is an exploded view to show the reciprocal device of the present invention.
Figure 2:
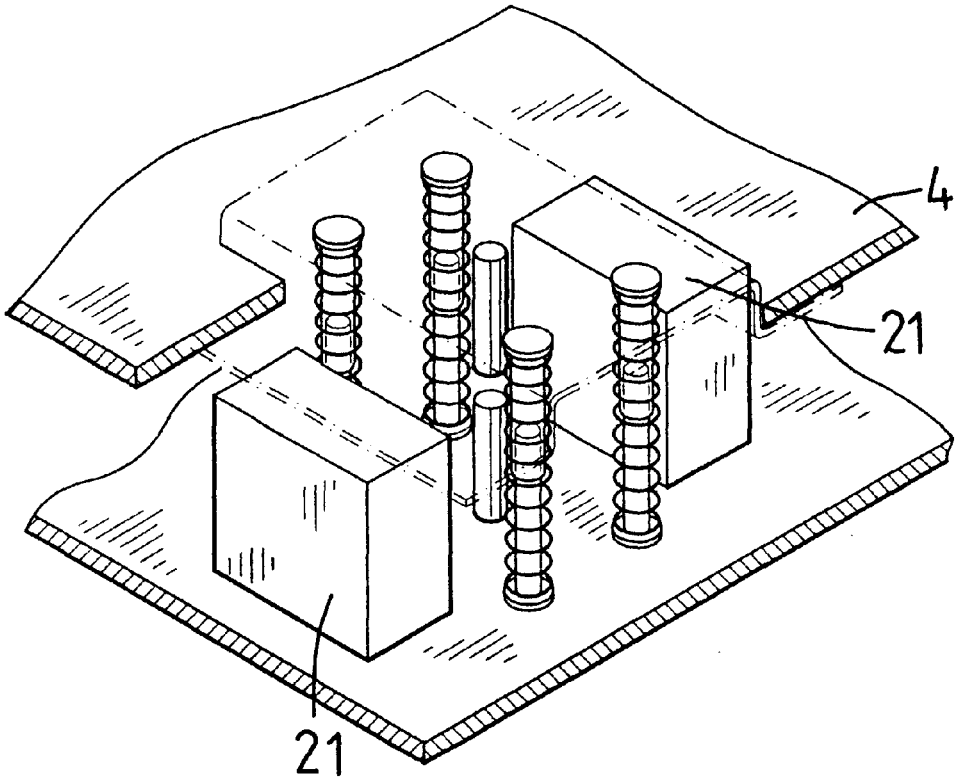
FIG. 2 is a perspective view to show the reciprocal device of the present invention.
Figure 3:
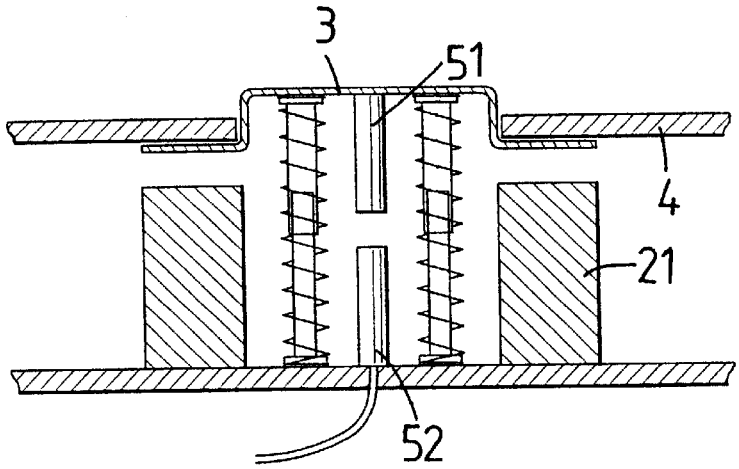
FIG. 3 is a cross sectional view to show the reciprocal device of the present invention.
Figure 4:
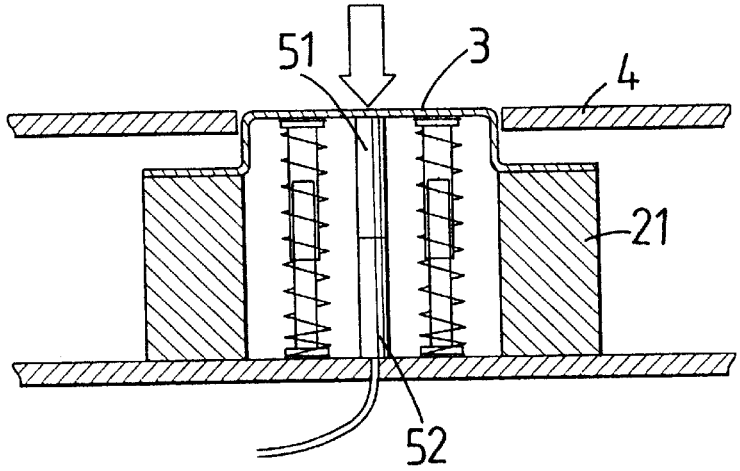
FIG. 4 shows that the movable member is stepped downward and stopped by the stop members.

Referring to FIGS. 1 to 4, the reciprocal device for exercise machines of the present invention comprises a base 2 having four positioning rods 22 and two stop members 21 on a top surface thereof and each positioning rod 22 has a spring 23 mounted thereto. The base 2 having a first sensing rod 52 extending from the top surface thereof.

A movable member 3 has four sockets 31 extending from an underside thereof and the sockets 31 are mounted to the springs 23 and the positioning rods 22. A second sensing rod 51 extends from the underside of the movable member 3. The first sensing rod 52 and the second sensing rod 51 are located in alignment with each other. The movable member 3 has a protrusion portion on a center of the top thereof.

A cover 4 is mounted to the movable member 3 and has an opening 41 through which the movable member 3 is movably engaged. When the user steps on the protrusion portion of the movable member 3, the movable member 3 is stopped by the stop members 21 and the first sensing rod 52 and the second sensing rod 51 contact with each other. A wire extends from the first sensing rod 52 and the contact of the two sensing rods 52, 51 sends a signal to a control unit (not shown) of the exercise machine to perform a desired action. When releasing the downward force on the movable member 3, the springs 23 bounce the movable member 3 to its original position.

Figure 5:
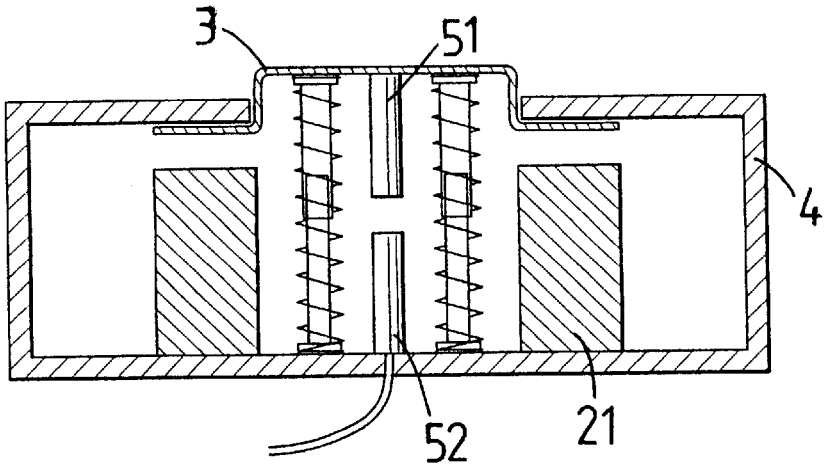
FIG. 5 shows the device has an enclosing type cover.
Figure 6:
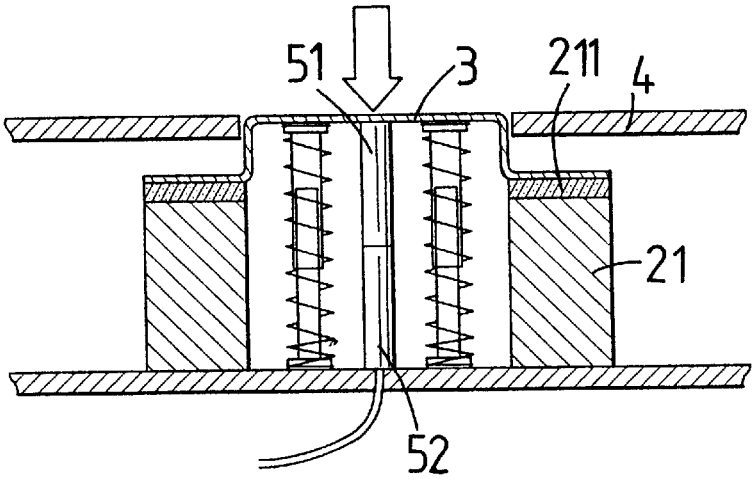
FIG. 6 shows the stop members have buffer piece on a top thereof.
Figure 8:
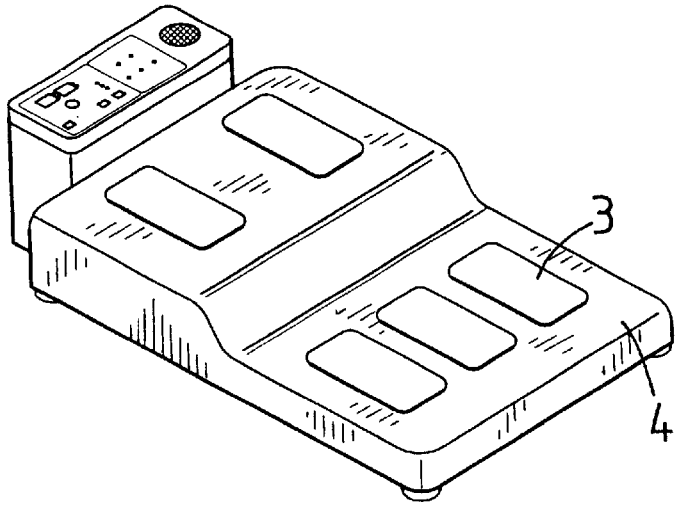
FIG. 8 shows the device is used on two stepped surfaces of a dancing machine.
Figure 7:
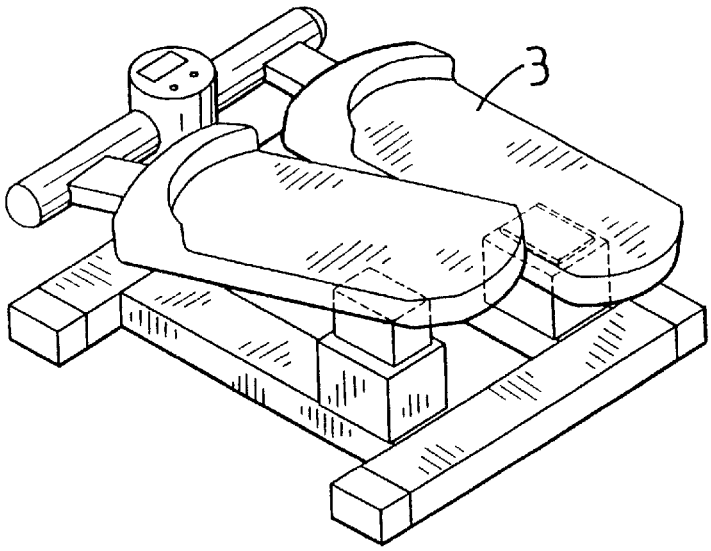
FIG. 7 shows the movable members are made in forms of pedal.
Figure 9:
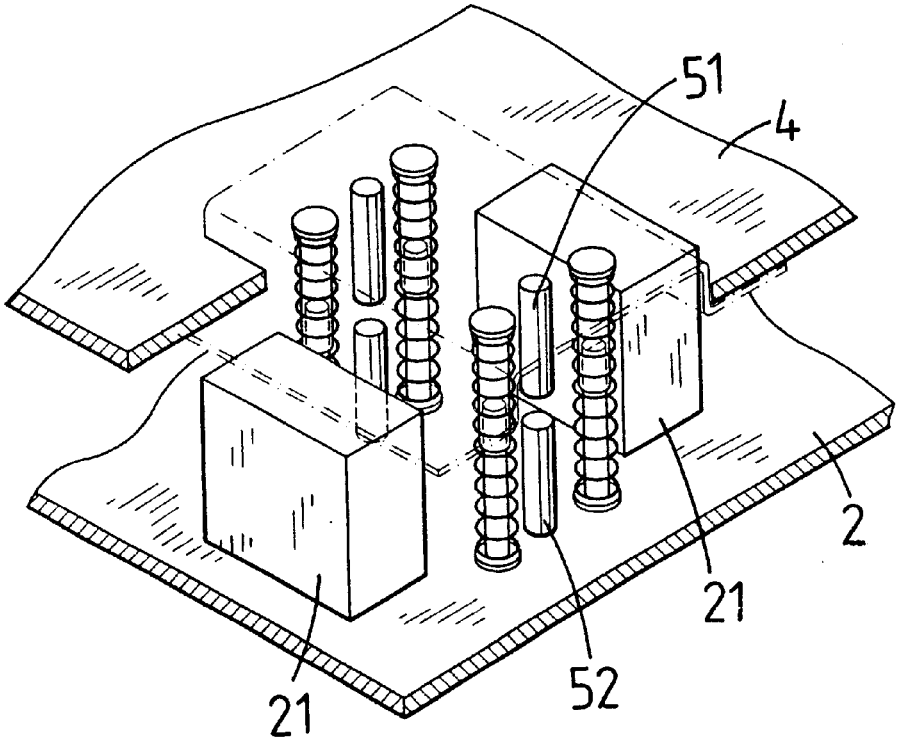
FIG. 9 shows the device includes two sets of sensing rods.

FIG. 5 shows that the cover 4 is an enclosing type cover. FIG. 6 shows that each stop member 21 has a buffer piece 211 which is soft and absorbs impact force when the movable member 3 contacts the stop members 21 so that the user feels soft and gentle when using the device. FIG. 7 shows that the movable members 3 are made in forms of pedals. FIG. 8 shows that the protrusion portion of the movable member 3 protrudes beyond a surface of the cover 4 and can be used to two stepped surfaces of a dancing machine. FIG. 9 shows that each movable member 3 includes two sets of sensing rods 51, 52 and each set of the sensing rods 51, 52 controls the action of the ball of the foot and the heel of the foot of the user.

Figure 10:
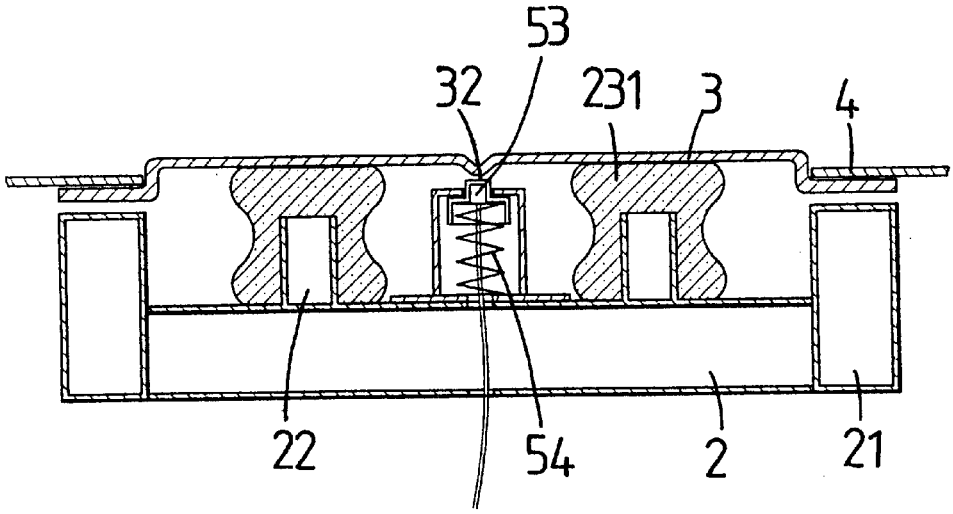
FIG. 10 is another embodiment of the device of the present invention.
Figure 11:
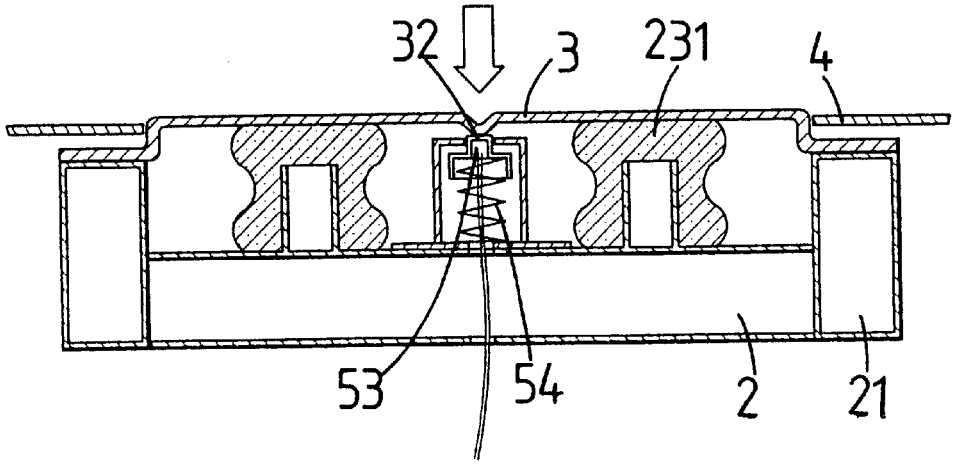
FIG. 11 shows the movable member in the device shown in FIG. 10 is stepped downward.
Figure 12:
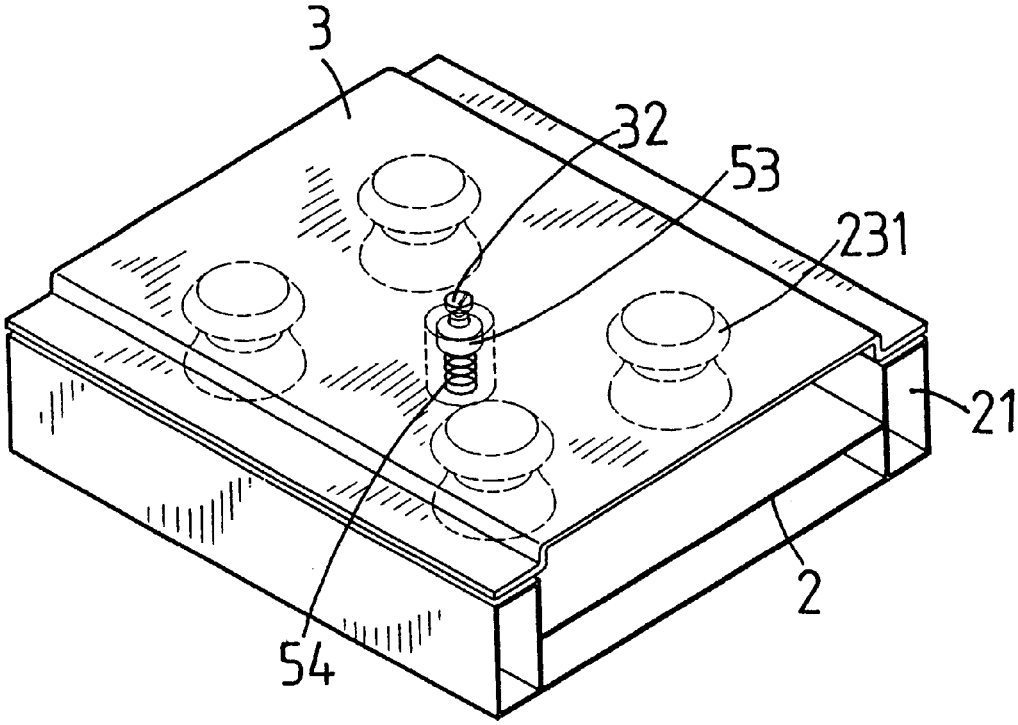
FIG. 12 shows the perspective view of the device shown in FIG. 10.

FIGS. 10 to 12 show another embodiment of the device wherein the base 2 has four positioning rods 22 and stop members 21 on a top surface thereof and each positioning rod 22 has a resilient member 231 mounted thereto. A sensing member 53 biased by a spring 54 which is fixed to the top surface of the base 2.

A movable member 3 has a protrusion 32 extending from an underside thereof and the protrusion 32 is located above the sensing member 53. The resilient members 231 contact the underside of the movable member 3. A cover 4 is mounted to the movable member 3. When the movable member 3 is stepped by a user, the protrusion 32 is lowered to touch the sensing member 53 to send a signal to perform a pre-set function.

While we have shown and described the embodiment in accordance with the present invention, it should be clear to those skilled in the art that further embodiments may be made without departing from the scope of the present invention.

What is claimed is:

1. A reciprocal device for exercise machines, comprising:

a base having a plurality of positioning rods and stop members on a top surface thereof and each positioning rod having a spring mounted thereto, the base having a first sensing rod extending from the top surface thereof;

a movable foot support member having a plurality of sockets extending from an underside thereof and the sockets mounted to the springs and the positioning rods, a second sensing rod extending from the underside of the movable member, the first sensing rod and the second sensing rod being located in alignment with each other, wherein the two said sensing rods contact and send a signal, and a cover mounted to the movable member.

2. The device as claimed in claim 1, wherein the cover has an opening through which the movable member is movably engaged.

3. The device as claimed in claim 2, wherein the movable member has a protrusion portion which protrudes beyond a surface of the cover.

4. A reciprocal device for exercise machines, comprising:

a base having a plurality of positioning rods on a top surface thereof and each positioning rod having a resilient member mounted thereto, a sensing member biased by a spring which is fixed to the top surface of the base;

a movable member having a protrusion extending from an underside thereof and the protrusion located above the sensing member, and a cover mounted to the movable member.

* * * * *